US007861318B2

(12) United States Patent
Grilliot et al.

(10) Patent No.: US 7,861,318 B2
(45) Date of Patent: Jan. 4, 2011

(54) PAD WEARABLE OVER ARTICULATED JOINT

(75) Inventors: William L. Grilliot, Dayton, OH (US); Mary I. Grilliot, Dayton, OH (US); Patricia K. Waters, Tipp City, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 456 days.

(21) Appl. No.: 11/699,120

(22) Filed: Jan. 29, 2007

(65) Prior Publication Data

US 2008/0178359 A1 Jul. 31, 2008

(51) Int. Cl.
*A41D 13/00* (2006.01)

(52) U.S. Cl. ..... 2/24; 2/16

(58) Field of Classification Search ..... 2/16, 2/22, 24, 455, 267, 268, 911
See application file for complete search history.

(56) References Cited

U.S. PATENT DOCUMENTS 1,044,494 A * 11/1912 Clarke ..... 2/23
1,654,452 A * 12/1927 Bradley ..... 2/227
5,065,457 A * 11/1991 Henson ..... 2/16
5,477,558 A * 12/1995 Volker et al. ..... 2/461
5,488,739 A * 2/1996 Cardinal ..... 2/161.1
5,500,955 A * 3/1996 Gongea ..... 2/24
6,065,152 A * 5/2000 Parker ..... 2/22
6,223,350 B1 * 5/2001 McFarlane ..... 2/24
6,519,781 B1 * 2/2003 Berns ..... 2/267
7,114,189 B1 * 10/2006 Kleinert ..... 2/24
D586,085 S * 2/2009 Lounsbury, Jr. ..... D2/742

* cited by examiner

*Primary Examiner*—Tejash Patel
(74) *Attorney, Agent, or Firm*—Wood, Phillips, Katz, Clark & Mortimer

(57) ABSTRACT

A pad, such as a knee, elbow, or shoulder pad, is wearable over an articulatable joint involving an arm of a wearer or a leg of a wearer and is constructed so as to define two flexing lines extending between an upper edge of the pad and a lower edge of the pad, which flexing lines define a central region of the pad and two lateral regions of the pad, so as to define a flexing line spaced from the central region and extending through each of the lateral regions, and so as to define plural flexing lines spaced from the upper and lower edges and from one another and extending across the central region, between the lateral regions. The pad comprises plural layers, which are sewn so as to define the flexing lines, and at least some of those layers are fabric layers.

13 Claims, 2 Drawing Sheets

PAD WEARABLE OVER ARTICULATED JOINT

FIELD OF THE INVENTION

This invention pertains to a pad, which is wearable over an articulatable joint of a wearer, particularly but not exclusively a knee, elbow, or shoulder pad for a protective garment.

BACKGROUND OF THE INVENTION

Herein, knees, elbows, and shoulders of a wearer are regarded as examples of large articulatable joints including the arm or leg of the wearer, while the knuckles of a wearer are regarded as examples of small articulatable joints of the wearer. Although this invention pertains particularly to a pad wearable over a large articulatable joint of a wearer, this invention may prove to be also pertinent to a pad wearable over a small articulatable joint of a wearer.

Commonly, protective garments for firefighters and for emergency workers are provided with knee, elbow, or shoulder pads, as exemplified in U.S. Pat. No. 5,896,583, No. 6,317,889, and No. 6,678,895. Because such garments can be somewhat stiff, particularly if such garments have plural layers including outer shells and insulative linings, it is desirable for such pads to be sufficiently flexible to avert stressing their wearers unduly.

SUMMARY OF THE INVENTION

This invention provides a pad, which is wearable over an articulatable joint (such as, for example, an elbow, shoulder or knee) involving an arm of a wearer or a leg of a wearer. The pad is constructed so as to define at least two flexing lines extending between an upper edge of the pad and a lower edge of the pad, which flexing lines define a central region of the pad and two lateral regions of the pad. The pad is constructed so as to define at least one flexing line spaced from the upper and lower edges and extending across the central region, between the lateral regions.

Preferably, the flexing line spaced from the upper and lower edges and extending across the central region is one of plural flexing lines, which are spaced from the upper and lower edges and from one another and which extend across the central region. Preferably, the pad is constructed so as to define a flexing line spaced from the central region and extending through each of the lateral regions.

Preferably, the pad comprises plural layers, which are sewn so as to define the flexing lines. Preferably, at least some of those layers are fabric layers.

Other objects, features, and advantages of the invention will become apparent from a review of the entire specification, including the appended claims and drawings.

DETAILED DESCRIPTION OF THE PREFERRED EMBODIMENTS

Figure 1:
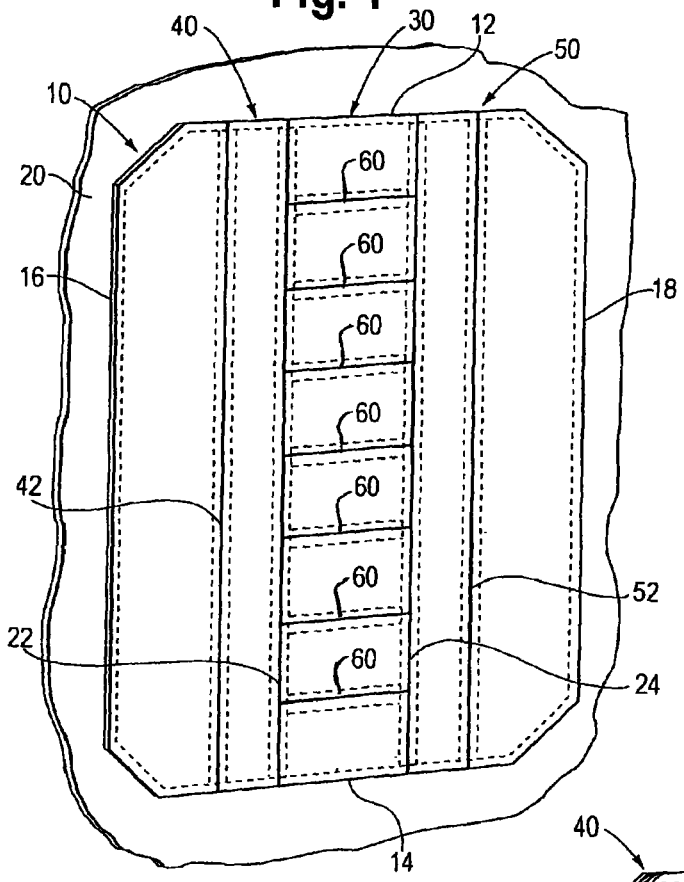
FIG. 1 is a perspective view of a knee pad embodying this invention.
Figure 2:
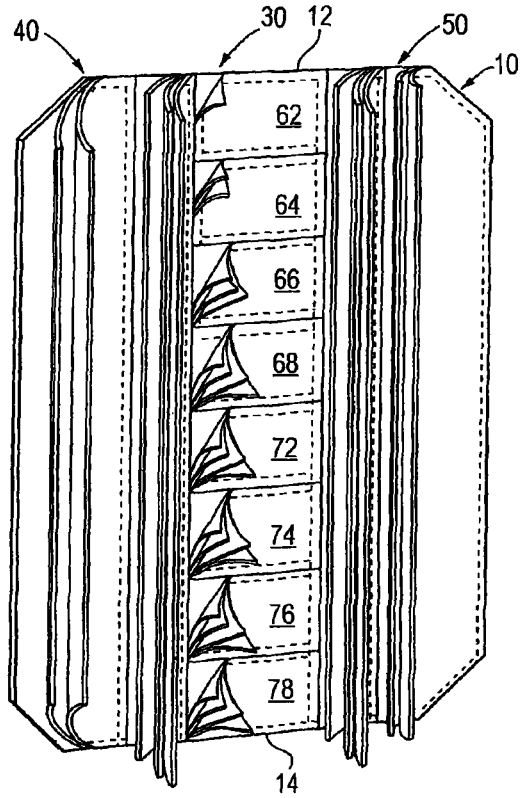
FIG. 2 is a similar view, in which some layers of the knee pad are illustrated as not being sewn fully and as being peeled outwardly, so as to illustrate that different regions of the knee pad have different numbers of such layers.
Figure 3:
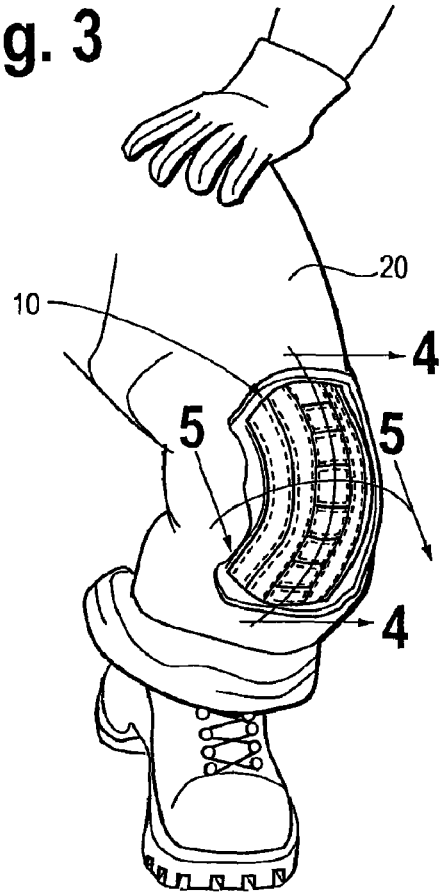
FIG. 3, on a smaller scale, is a fragmentary, perspective view of the knee pad, as attached to one leg of a pair of protective pants being worn by a wearer, such as a firefighter.

As illustrated, a knee pad 10 having an upper edge 12, a lower edge 14, and two lateral edges 16,18, is sewn to one leg 20 of a pair of protective pants, as worn by a wearer. Herein, directional terms, such as "upper", "lower", and "lateral" are used to refer to the knee pad 10 in a convenient orientation, in which the knee pad 10 is illustrated, but are not used to limit this invention to any particular orientation.

As provided by this invention, the knee pad 10 is constructed so as to define two flexing lines 22,24, which extend between the upper and lower edges 12,14. As defined by the flexing lines 22,24, the knee pad 10 has a central region 30, a lateral region 40, which extends between the central region and the lateral edge 16 and between the upper and lower edges 16,18, and a lateral region 50, which extends between the central region 30 and the lateral edge 18 and between the upper and lower edges 16,18.

Further, the knee pad 10 is constructed so as to define a flexing line 42, which is spaced from the central region 30, which is spaced from the lateral edge 16, and which extends through the lateral region 40, between the upper and lower edges 16,18. Further, the knee pad 10 is constructed so as to define a flexing line 52, which is spaced from the central region 30, which is spaced from the lateral edge 18, and which extends through the lateral region 50, between the upper and lower edges 16,18.

Further, the knee pad 10 is constructed so as to have seven flexing lines 60, which are spaced from the upper and lower edges 12,14, and from one another, which extend across the central region 30, between the lateral regions 40,50, and which divide the central region 30 into eight subregions discussed below.

As illustrated, the knee pad 10 is constructed from plural layers, which are sewn to one another so as to define the flexing lines described above. At least some of those layers are fabric layers. Preferably, all of those layers are fabric layers. Thus, an uppermost subregion 62 of the central region 30 has one layer, the next subregion 64 of the central region 30 has two layers, the next subregion 66 of the central region 30 has three layers, the next subregion 68 of the central region 30 has four layers, and each of the other subregions 72,74,76,78, of the central region 30 has four layers. Also, each of the lateral regions 40,50, has four layers.

Figure 4:
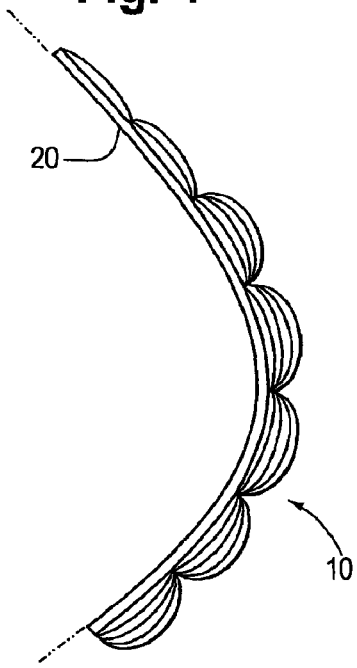
FIGS. 4 and 5, on a larger scale, are sectional views taken, respectively, along line 4-4 and line 5-5 of FIG. 3, in directions indicated by arrows.
Figure 5:
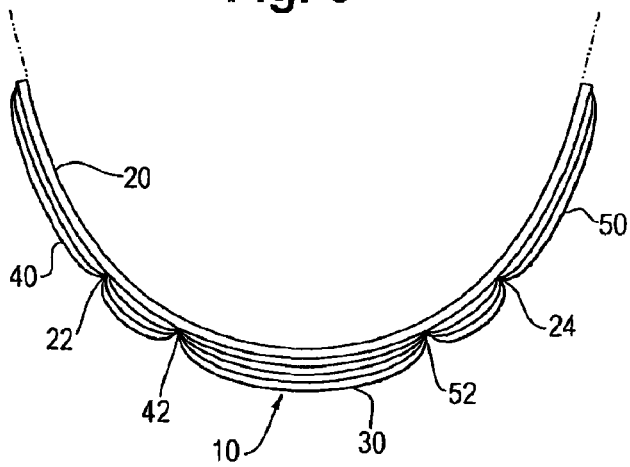

While FIGS. 4 and 5 illustrate the knee pad 10 as if it is sewn directly to the fabric of the pant leg 20, it should be understood that the pad 10 can be permanently attached, as shown in FIGS. 4 and 5, or releasably attached to the pant leg 20. In this regard, the pad 10 could include a base layer which would be in the position of the material 20 shown in FIGS. 4 and 5 and to which the remaining layers of the pad 10 would preferably be sewn. The base layer could then be sewn to the material of the pant leg 20, such as, for example, around the perimeter of the pad 10. Alternatively, the pad 10 could be attached using suitable releasable fasteners, such as Velcro fasteners or snap fasteners, or could be inserted into a pocket provided in the pant leg 20.

Preferably, the single layer of the subregion 62 of the central region 30, the outermost layer of each of the other subregions of the central region 30, and the outermost layer of each of the lateral regions 40,50, is made from an abrasion-resistant, flame-resistant fabric, such as Nomex™ fabric or Kevlar™ fabric, of a type used to commonly make the outer shells of protective garments for firefighters. Preferably, the remaining layers of each of the subregions 64-78 and the lateral regions 40 and 50 are made from a suitable thermal barrier or thermal lining material, which could be felt or the like or, preferably, is a "fluffy" or "lofty" type filler material. Additionally, a moisture barrier layer could be provided between any outermost layer in the pad 10 and any thermal barrier or thermal lining layers.

The flexing lines 22,24,42,44, facilitate flexing of the knee pad 10 with little stress, so as to wrap partly around the wearer's leg covered by the pants leg 20, whether the wearer's leg covered by the pants leg 20 is straight or is bent at the wearer's knee. The flexing lines 60 facilitate flexing of the knee pad 10 with little stress as the wearer's leg is bent at the wearer's knee.

As best seen in FIGS. 4 and 5, each of the flexing lines 22, 24, 42, 52 and 60 have a reduced thickness relative to the thickness of each region 30,40,50 adjacent the flexing lines 22,24,42,52,60.

It should be appreciated that while the pad 10 has been described herein in connection with the knee of a pant leg 20, the pad 10 could be provided on other portions of a garment to protect other articulatable joint. For example, the pad 10 could be applied to the elbow of the sleeve of a garment, or to the shoulder of a garment in the same fashion as it has been described in connection with the knee of the pant leg 20.

The invention claimed is:

1. A pad, which is wearable over an articulatable joint involving an arm of a wearer or a leg of a wearer, wherein the pad is constructed so as to define two flexing lines extending from an upper edge of the pad to a lower edge of the pad, which flexing lines define a central region of the pad and two lateral regions of the pad extending continuously from the upper edge to the lower edge; and wherein the pad is constructed so as to define a flexing line spaced from the upper and lower edges and extending across the central region, between the lateral regions; and wherein the pad comprises plural layers, which are attached so as to define the flexing lines, each of the regions having a thickness and each of the flexing lines having a reduced thickness relative to the thickness of each region adjacent the flexing line.

2. The pad of claim 1, wherein the flexing line spaced from the upper and lower edges and extending across the central region is one of plural flexing lines, which are spaced from the upper and lower edges and from one another and which extend across the central region.

3. The pad of claim 1, wherein the pad is constructed so as to define a flexing line spaced from the central region and extending through each of the lateral regions.

4. The pad of claim 2, wherein the pad is constructed so as to define a flexing line spaced from the central region and extending through each of the lateral regions.

5. The pad of claim 1, wherein at least some of the layers are fabric layers.

6. A pad, which is wearable over an articulatable joint involving an arm of a wearer or a leg of a wearer, wherein the pad is constructed so as to define two flexing lines extending between an upper edge of the pad and a lower edge of the pad, which flexing lines define a central region of the pad and two lateral regions of the pad; and wherein the pad is constructed so as to define a flexing line spaced from the upper and lower edges and extending across the central region, between the lateral regions; and wherein the pad comprises layers of fabric that are sewn so as to define the flexing lines, each of the regions having a thickness and each of the flexing lines having a reduced thickness relative to the thickness of each region adjacent the flexing line.

7. The pad of claim 6, wherein the flexing line spaced from the upper and lower edges and extending across the central region is one of plural flexing lines, which are spaced from the upper and lower edges and from one another and which extend across the central region.

8. The pad of claim 6, wherein the pad is constructed so as to define a flexing line spaced from the central region and extending through each of the lateral regions.

9. The pad of claim 7, wherein the pad is constructed so as to define a flexing line spaced from the central region and extending through each of the lateral regions.

10. The pad of claim 1 wherein the reduced thickness of each flexing line is no greater than 75% of the thickness of each region adjacent the flexing line.

11. The pad of claim 1 wherein the reduced thickness of each flexing line is no greater than 50% of the thickness of each region adjacent the flexing line.

12. The pad of claim 6 wherein the reduced thickness of each flexing line is no greater than 75% of the thickness of each region adjacent the flexing line.

13. The pad of claim 6 wherein the reduced thickness of each flexing line is no greater than 50% of the thickness of each region adjacent the flexing line.

* * * * *